US005556286A

United States Patent [19]

Ikesugi et al.

[11] Patent Number: 5,556,286

[45] Date of Patent: Sep. 17, 1996

[54] BOARD TO BOARD CONNECTOR

[75] Inventors: Hiroshi Ikesugi; Junichi Miyazawa, both of Yokohama, Japan

[73] Assignee: Molex Incorporated, Lisle, Ill.

[21] Appl. No.: 419,578

[22] Filed: Apr. 10, 1995

[30] Foreign Application Priority Data

May 25, 1994 [JP] Japan ..... 6-007099 U

[51] Int. Cl.[6] ..... H01R 9/09

[52] U.S. Cl. ..... 439/74; 439/31; 439/247

[58] Field of Search ..... 439/31, 74, 83, 439/246, 247, 248, 284, 295, 660

[56] References Cited

U.S. PATENT DOCUMENTS 4,695,106 9/1987 Feldman et al. ..... 439/83
4,971,565 11/1990 Fox, Jr. ..... 439/74
5,174,761 12/1992 Kodaira ..... 439/31
5,199,884 4/1993 Kaufman et al. ..... 439/74
5,277,597 1/1994 Masami et al. ..... 439/83
5,376,009 12/1994 Olsson et al. ..... 439/74
5,388,997 2/1995 Grange et al. ..... 439/247
5,499,924 3/1996 Arisaka et al. ..... 439/74

*Primary Examiner*—Gary E. Elkins
*Attorney, Agent, or Firm*—Charles S. Cohen

[57] ABSTRACT

An electric connector has a housing with an inclined support flange at opposing ends. The inclined portions of these support flanges permit the housing to tilt, or rotate, slightly around the centerline of the connector in order to compensate for offset which may occur between the longitudinal centerline of the connector and a mating connector.

22 Claims, 9 Drawing Sheets

PRIOR ART

PRIOR ART

BOARD TO BOARD CONNECTOR

BACKGROUND OF THE INVENTION

The present invention relates generally to board-to-board electrical connectors and more particularly, to a board-to-board connector having the ability to compensate for misalignment of mating connectors.

Electrical connectors are sometimes used to connect one printed circuit board to another printed circuit board while the two circuit boards assume a horizontal, parallel relationship. Usually, such connectors are fixed to opposing surfaces of the two printed circuit boards. Such board-to-board connectors include a female connector member, referred to as a receptacle, which is fixed to one printed circuit board and a corresponding male member, referred to as a plug, which is fixed to the other printed circuit board. The plug and receptacle connectors engage each other by a press-fit engagement.

The connectors are typically mounted on printed circuit boards by either manual labor or by automated—mounting tools. The connector housings are mounted on their respective opposing circuit boards in alignment with each other and with respect to certain predetermined reference mounting lines on the printed circuit boards. This alignment includes alignment of the opposing connectors in both lateral and transverse directions. However, if any of the connectors are mounted slightly offset from the reference line on one of the printed circuit boards, this offset will cause misalignment between the offset connector and its mating connector, and increases the likelihood of poor electrical connection between the circuits of the two circuit boards. A small amount of misalignment will not present a problem when only one connector on each board is being mated together if nothing is restricting the movement of one of the boards.

Where multiple connectors are mounted to each of the opposing circuit boards and one of them is misaligned, the connectors of one circuit board may not completely mate with, or engage the opposing connectors on the opposing circuit board. Forced mating of the opposing plug and receptacle connectors may lead to distortions in or imposition of detrimental stress on the connector housing and terminals. As a result, poor electrical connections may occur between the printed circuit boards.

As understood from the above, it can be appreciated that conventional board-to-board connectors have the following disadvantages. First, if any of the plug or receptacle connectors fixed to the circuit board are offset from a predetermined longitudinal mounting reference line on one of the circuit boards, the male and female terminals held within the opposing connectors of the engaged connectors will be strongly forced against each other on one side of the housings while the male and female terminals on the other side of the housings are prone to be spaced apart. Thus, it is possible that reliable electric connections will not occur.

Secondly, the offset amount between the longitudinal centerline of the plug or receptacle and the circuit board longitudinal mounting reference line may remain within the gap which appears between the opposing sidewalls of the plug and receptacle housings but also increase the gap on one side and reduce it on the other side. This offset in the larger gap area may cause vibration between the plug and receptacle housings, which is noticeable particularly when such electric connectors are used in printed circuit boards installed in vehicles. Such vibration will cause chattering at contacts, causing malfunctions in associated circuits and excessive wearing of contacts.

The present invention overcomes these disadvantages and provides benefits over the prior art by providing an improved surface mount board-to-board connector which permits increased tolerances to misalignment in the mounting of connectors without degradation of performance.

Accordingly, it is a general object of the present invention to provide a new and improved surface mount, board-to-board connector.

Another object of the present invention is to provide a surface mount electrical connector which assures reliable, good electric connections despite an offset between the longitudinal centerline of the plug or receptacle and a longitudinal reference mounting line on associated printed circuit boards.

Yet another object of the present invention is to provide a surface mount board-to-board connector for interconnecting two opposing circuit boards together, the connector including two interengageable connector halves, each of the connector halves having an elongated housing, each housing having two flanges disposed on opposite ends thereof and extending from the housings toward respective circuit boards, the flanges having a central portion aligned with the centerlines of the housings, the flanges further having diverging surfaces which extend away from the housing centerlines and from the circuit boards, the diverging surfaces permitting the connector housings to tilt about their centerlines to thereby effect a reliable engagement between the connector halves when one of the connector halves is misaligned from a reference mounting line on one circuit board.

SUMMARY OF THE INVENTION

The present invention is therefore directed to an improved board-to-board connector which offers increased reliability in its connection between circuit boards and permits a greater tolerance to misalignment.

The present invention accomplishes these objects by providing male and female connectors which mate together, wherein each male and female connector includes a plurality of male and female terminals, respectively, fixed at regular intervals. Each connector housing has a flange member connected to its opposing ends with two opposing inclined surfaces. The inclined surfaces of the flanges extend away from the centers of the flanges to the ends of the support flanges and away from the circuit board mounting surface. The inclined surfaces permit the connectors to rotate, or tilt, slightly about their centerlines. This movement compensates for any misalignment caused by an offset of a connector from a reference mounting line, thereby alleviating any adverse effect on the terminal-to-board connections.

The support flanges may have a center portion which contacts the circuit board and which provides a fulcrum about which the housing may rotate. The inclined surfaces may take a variety of forms such as a linear or curvilinear surface, or even a stepped surface so long as the surfaces extend away from the circuit board in a manner which will permit the connector to rotate or tilt.

These and other objects, features and advantages of the present invention will be clearly understood through a consideration of the following detailed description.

BRIEF DESCRIPTION OF THE DRAWINGS

In the course of the following detailed description reference will be made to the attached drawing wherein like reference numerals identify like parts and wherein.

DETAILED DESCRIPTION OF THE DETAILED EMBODIMENTS

The disadvantages of the prior art will be discussed first in order that the operation of the invention and the benefits and advantages of the invention may be more readily appreciated.

Figure 11:
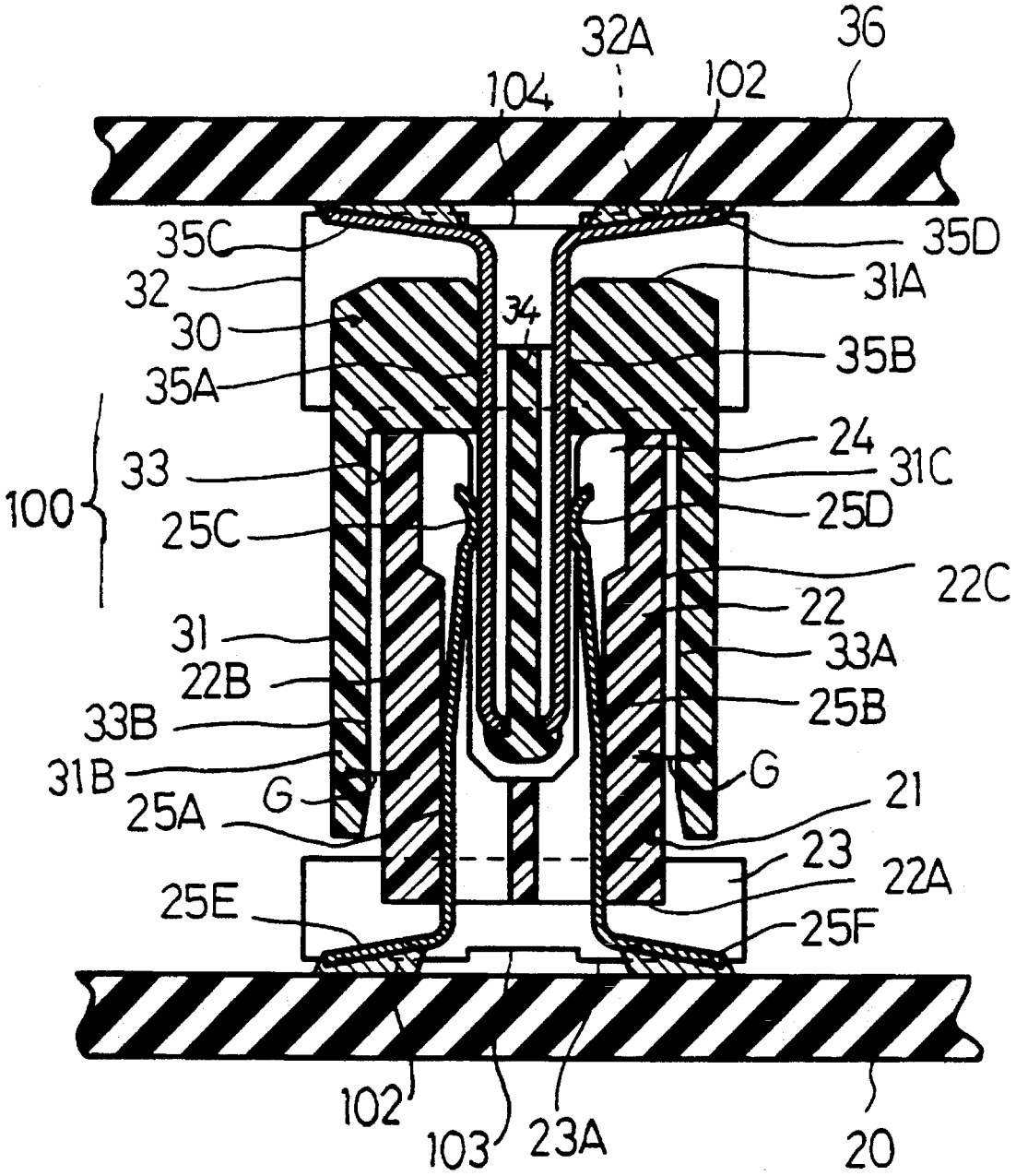
FIG. 11 is a cross-sectional view of a conventional prior art surface mount board-to-board connector wherein the connector components are aligned in their engagement with each other.
Figure 12:
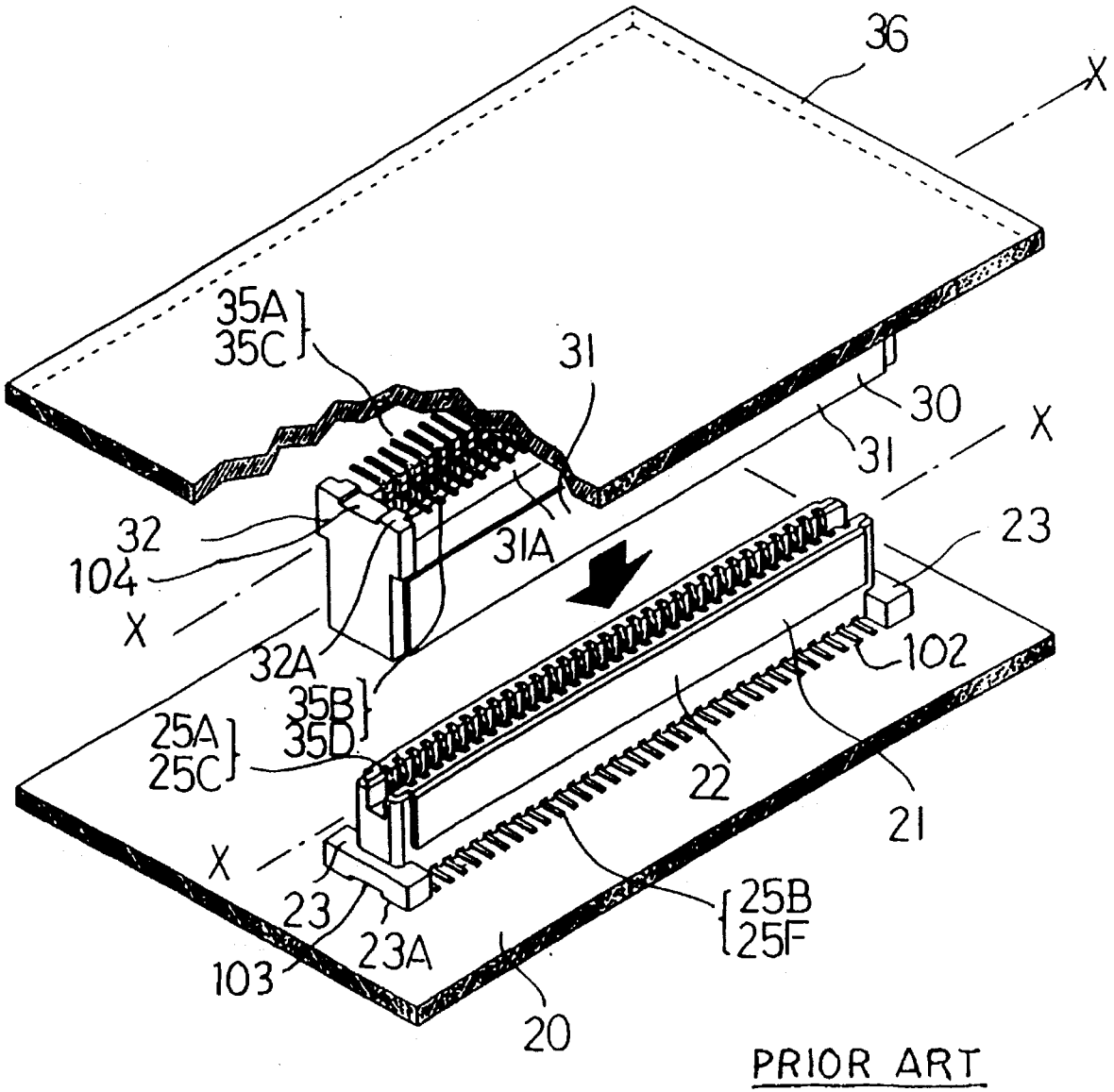
FIG. 12 is a perspective view of the plug assembly of the conventional electric connector fixed to a printed circuit board and receptacle assembly of the conventional electric connector fixed to another circuit board; and, FIG. 13 is a cross sectional view of the connector of FIG. 11 wherein the two opposing connector components are misaligned in their engagement.
Figure 13:
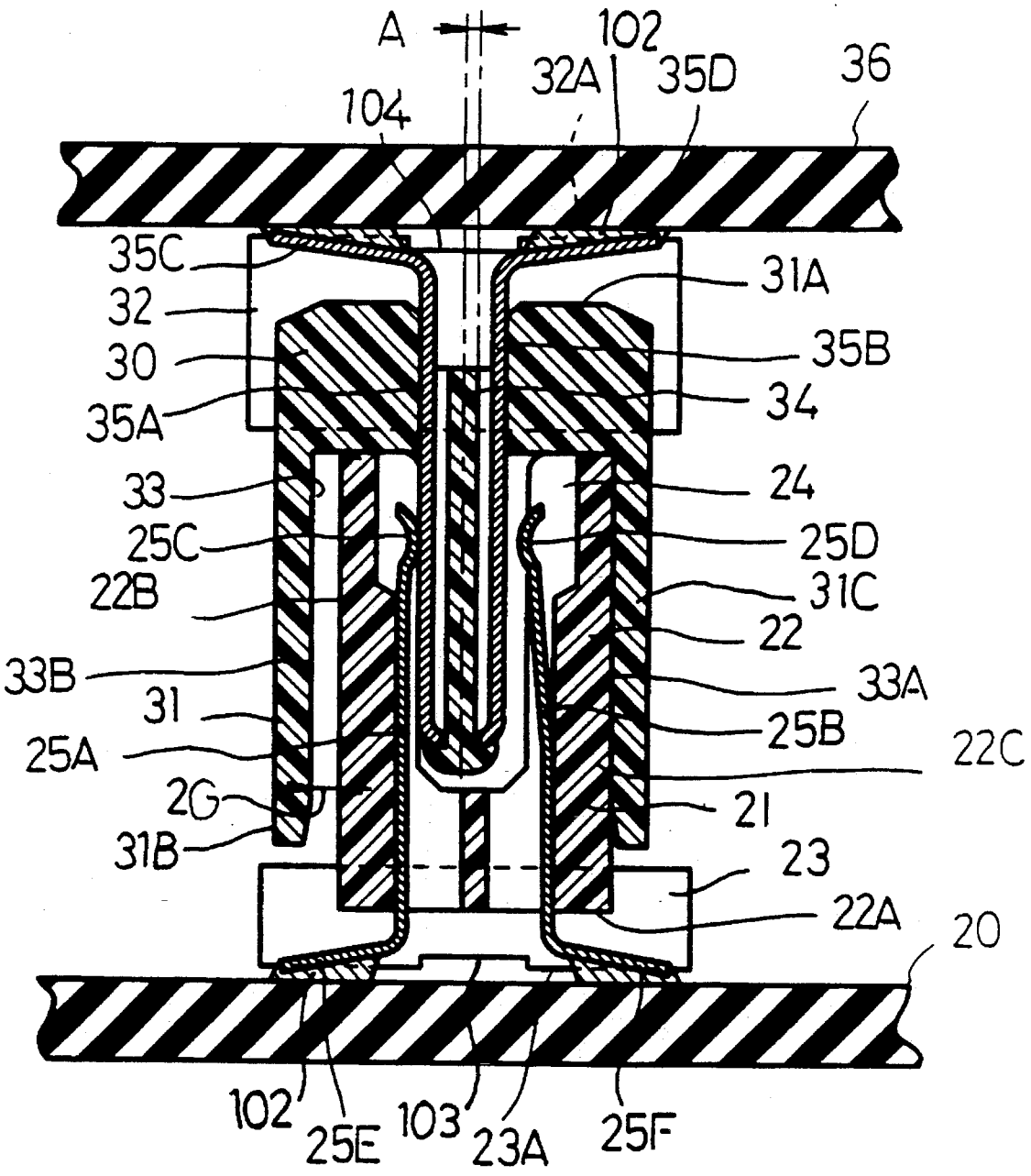

A conventional surface mount board-to-board connector 100 is illustrated in FIGS. 11–13 and includes a receptacle member 21 and an opposing plug member 30. The receptacle member 21 includes an elongated housing 22 having a cavity disposed lengthwise therein between two sidewalls 22B, 22C containing opposing rows of electrical terminals 25A, 25B held within recesses 24 formed within the sidewalls 22B, 22C. As illustrated in FIGS. 11 and 13, each terminal 25A, 25B has a general L-shape with a vertical leg portion rising upwardly within the housing. Each terminal further has a horizontal leg, or solder tail portion 25E, 25F. The vertical leg portions of the terminals 25A, 25F include a contact portion 25C formed at its upper end and the lower solder tail portion extends transversely out of the housing at the bottom thereof where it will engage a trace or contact pad located on the surface of the circuit board 20 by way of soldering such that a solder connection 102 is formed between the two.

The receptacle member 21 further includes a transverse support or flange, 23 (FIG. 12) at each end of the housing, which may or may not support the receptacle member 21 in place upon the circuit board 20. The flanges 23 have flat bottom surfaces 23A which extend parallel to the circuit boards 20, 36. A recess 103 may be provided in the central portion of the bottom surface 23A of the support flanges 23.

A counterpart plug member 30 is provided for engagement with the receptacle member 21 and also includes an elongated housing 31 (FIG. 12). The plug member housing 31 includes an interior cavity 33 which surrounds a plug portion 34 extending lengthwise therein which is formed from a dielectric material and which is shown as extending downwardly in FIGS. 11–13. Pairs of associated terminals 35A, 35B are disposed on opposite sides of the plug portion 34 and also have a general L-shape such that each terminal 35A, 35B includes a vertical leg portion and a horizontal support leg, or solder tail portion 35C, 35D, which extends through the bottom 31A of the plug housing 31. These solder tail portions 35C, 35D are connected, such as by soldering, to a corresponding trace or contact pad arranged on the opposing printed circuit board 36.

The plug member 30 also includes, at each end, a flange 32 which extends generally transversely out from the housing 31. The flanges 32 have a generally flat bottom surface 32A which abuts the surface of the circuit board 36 and includes a central recess 104 disposed there.

Figure 10:
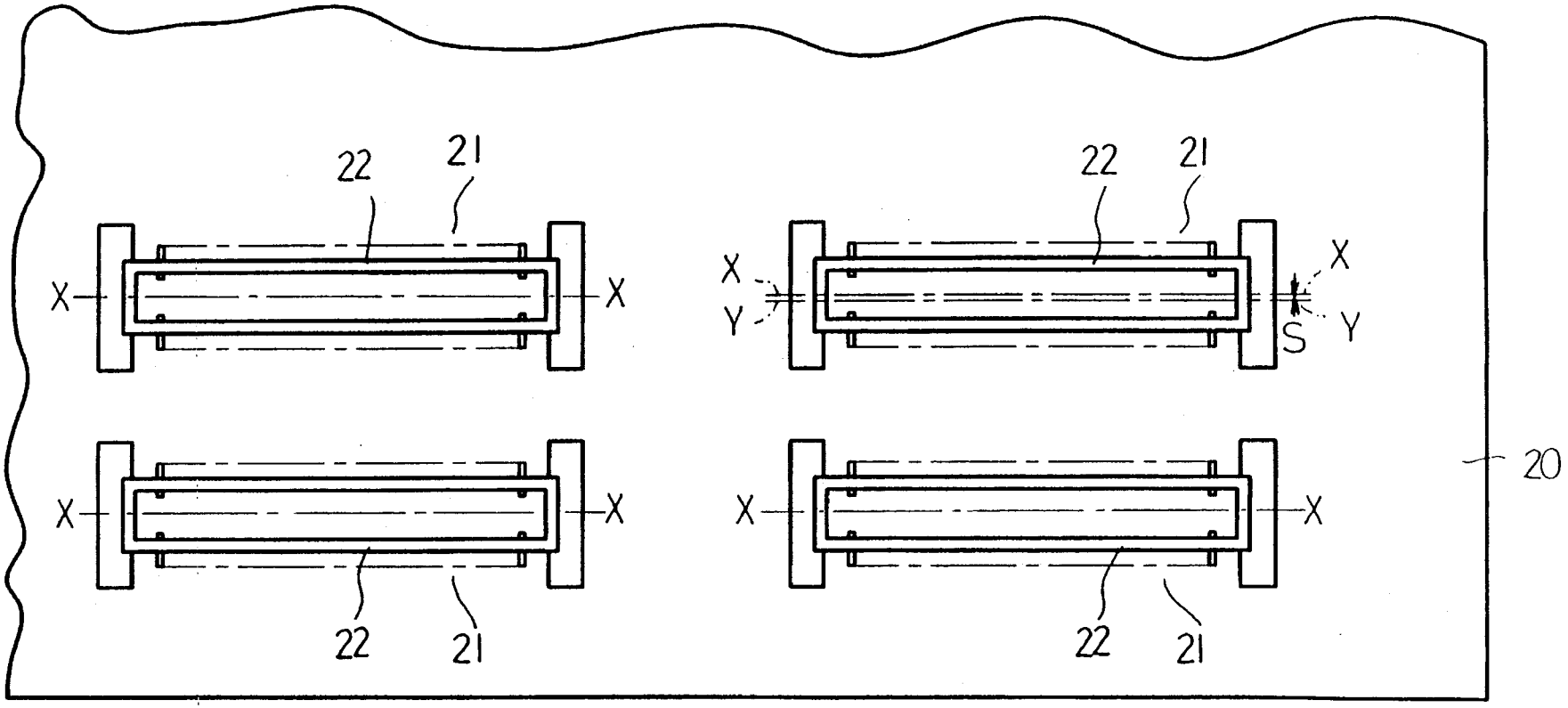
FIG. 10 is a top plan view of a printed circuit illustrating an array of surface mount connectors arranged in parallel and series upon the circuit board.

FIG. 10 illustrates an array of receptacle members 21 arranged on a circuit board 20. Four receptacle housings 22 are shown arranged in both parallel and series fashion on the circuit board with each receptacle housing 21 having a longitudinal centerline X—X which is intended to align with respective predetermined reference mounting line Y—Y on the circuit board. Three of the connectors illustrated in FIG. 10 are aligned with their respective predetermined reference mounting lines, while the fourth connector, illustrated in the upper right hand portion of FIG. 10 is misaligned on the circuit board because its centerline X—X is offset from the reference mounting line Y—Y. This offset is indicated at S. The connectors may be mounted to the circuit boards solely by the solder tail portions as depicted in FIGS. 11 and 13 or they may also include registration pins which extend down from the connector housings and are received within corresponding holes in the circuit boards (not shown).

When the two circuit boards 20, 36 are brought together in a proper engagement (FIG. 11), the receptacle housing longitudinal walls 22B, 22C of the receptacle member 21 enter the opposing recess 33 of the plug member 30 evenly so that the male terminals 35A, 35B of the plug housing 31 smoothly fit into the receptacle central cavity 24 between the rows of opposing female terminals 25C, 25D. In this type of mating, no misalignment, or offset occurs, between centerlines of the opposing plug and receptacle housings 22, 31 so no external forces are applied to the male and female terminals by interference between opposing sidewalls 31B, 31C and 22B, 22C of the plug and receptacle housings 22, 31. A gap G is defined between the receptacle housing sidewalls 22B, 22C and the plug housing sidewalls 31B, 31C.

However, in instances where at least one of the two connector members is misaligned in its mounting position upon the circuit board, such as illustrated in FIG. 10, an improper mating between the connectors may occur as illustrated in FIG. 13. This misalignment is indicated by the offset at "A" which represents a shifting slightly leftward of the plug member 30 from its appropriate centerline. When such an offset occurs, it can be seen that right sidewall 22C of the receptacle member 21 forcibly contacts the right sidewall 31C of the plug member 30 which results in the leftmost male terminals 35A being pushed against the leftmost female terminals 25A such that the rightmost male terminals 35B are driven apart from either secure contact or partial contact with the rightmost female terminals 25B. Where the contacts do not meet, the connector will not serve its intended purpose. Where only a partial contact is made, such a contact may result in chattering, excessive wear on the contacts or intermittent connection. In this misaligned engagement, there is no longer an even gap G between the plug and receptacle housing sidewalls as illustrated in FIG. 11, but rather there appears a new, wider gap 2G between the leftmost sidewalls of the plug and receptacle housings.

Figure 1:
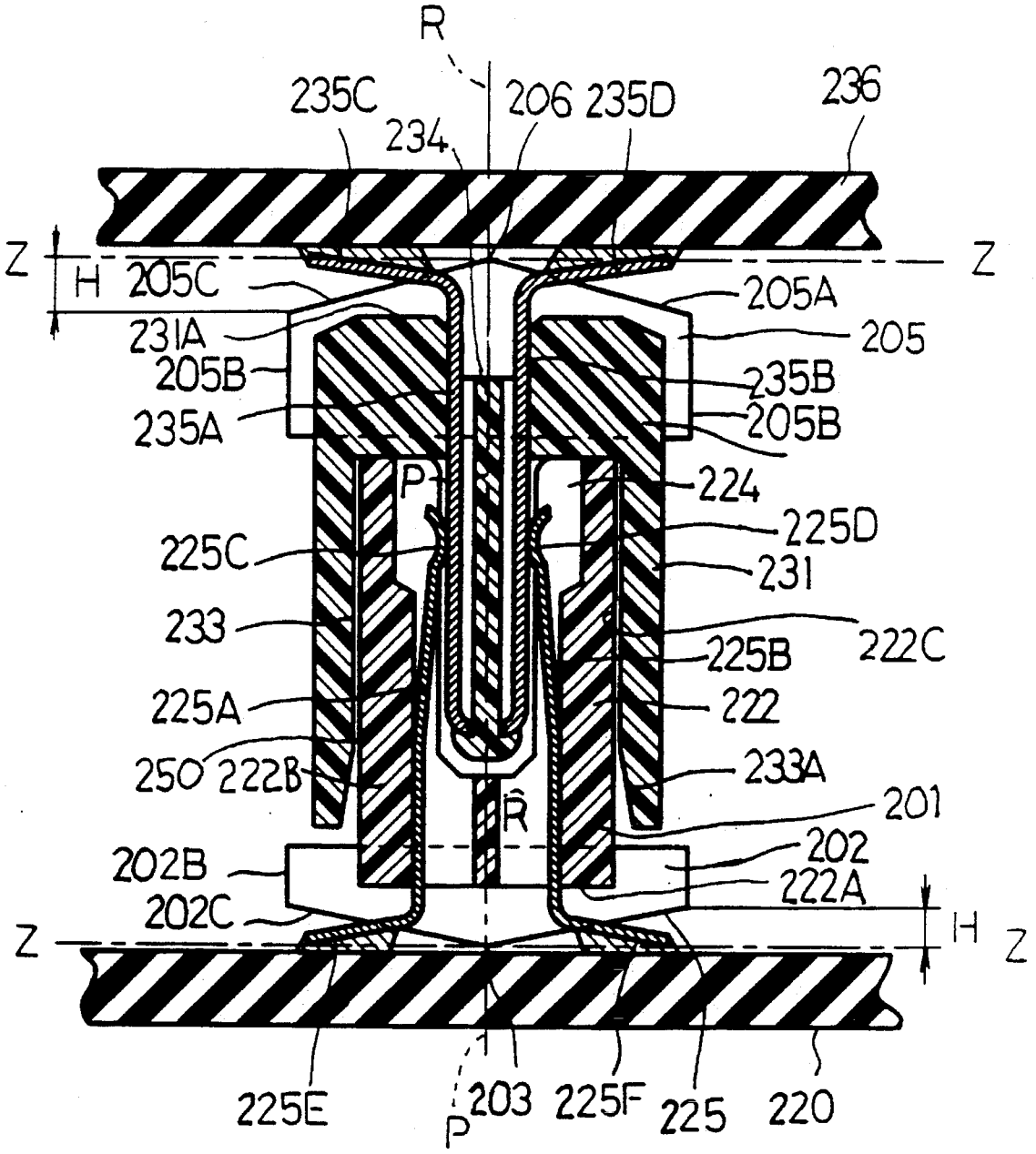
FIG. 1 is a cross-sectional view of a surface mounting type of electric connector constructed in accordance with the principles of the present invention.
Figure 2:
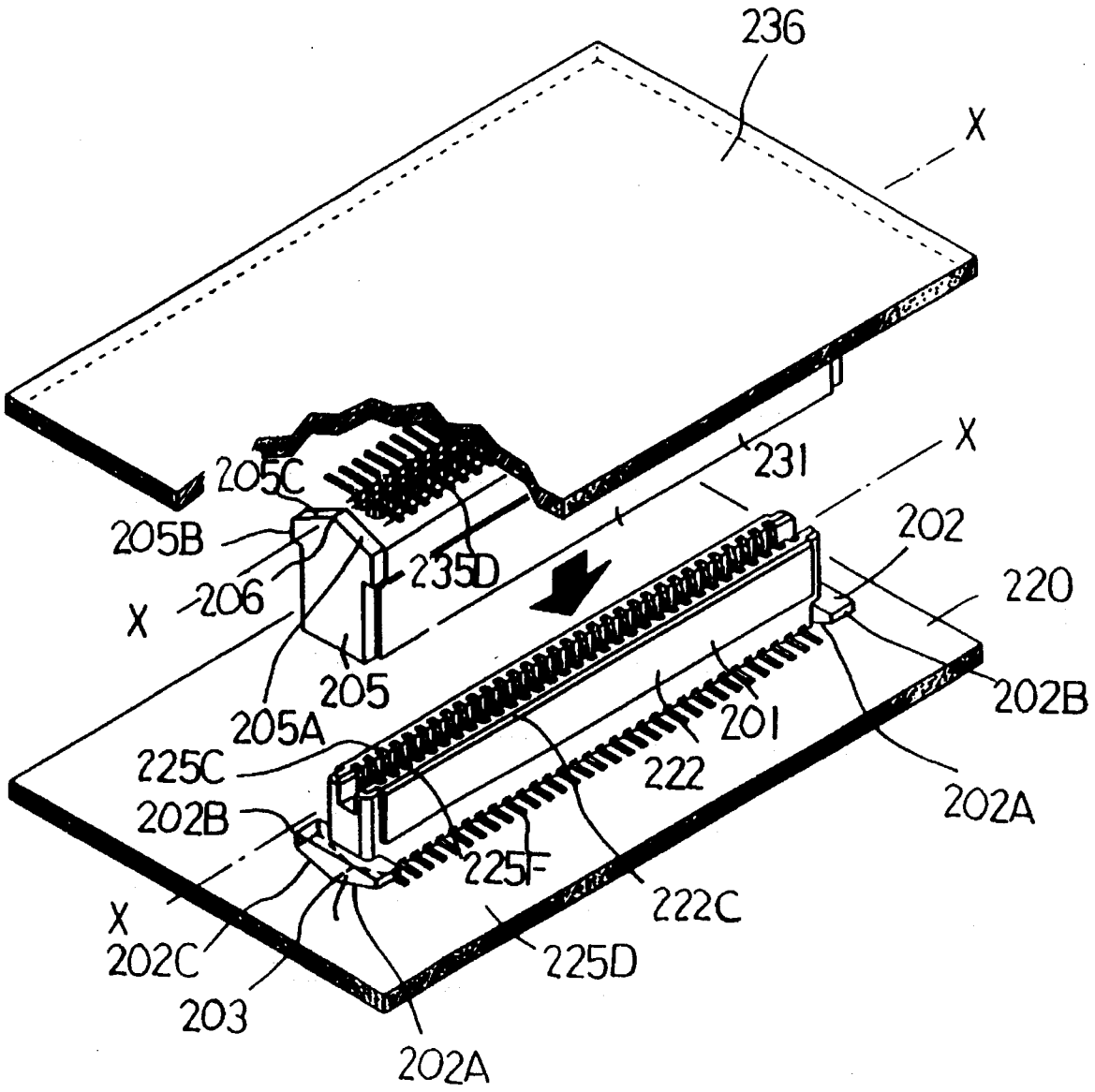
FIG. 2 is a partially exploded perspective view of the connector assembly of FIG. 1 mounted in place on two opposing printed circuit boards.

Referring now to FIGS. 1 and 2, a connector constructed in accordance with the principles of the present invention which presents a solution to the aforementioned problems is illustrated generally at 200. The connector 200 includes a receptacle member 201 fixed to a printed circuit board 220. The receptacle member 201 is similar in structure to that previously described in that it includes an elongated housing 222 having opposing sidewalls 222B and 222C and a central recess 223.

In an important aspect of the present invention, the receptacle housing 222 includes a support or flange 202 connected to each of the opposing ends of the housing 222 and which extend transversely outwardly therefrom and which form a structure which permits the housing 222 to be "rocked" or slightly rotated, about its centerline. In the embodiment depicted in FIGS. 1–3, the flanges 202 extend beneath the bottom 222A of the receptacle housing 222 and above the circuit board 220. The flanges 202 include a central ridge portion 203 located along the longitudinal centerline of the housing and further include two inclined flange surfaces 202C on opposite sides of the housing centerline. These inclined surfaces extend, or "diverge" away from the ridge 203 and away from the circuit board 220 (shown upwardly in FIGS. 1–3). The incline of the surface 202C (i.e., the distance between the inclined surface 202C and the surface of the circuit board 220) increases as the surface extends transversely away from the centerline of the housing as illustrated in FIG. 1.

Figure 3:
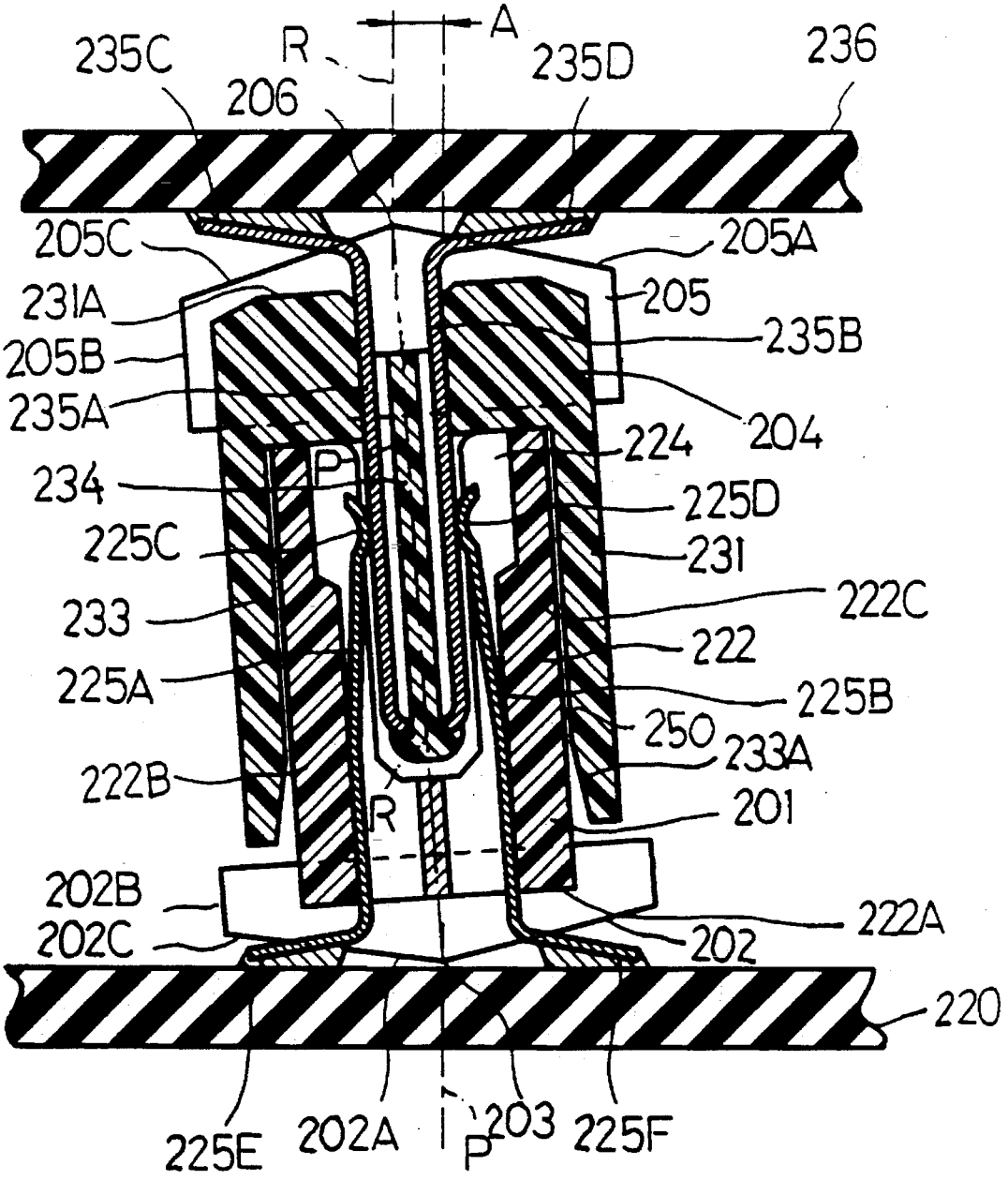
FIG. 3 is a cross-sectional view of a connector of the present invention illustrating showing the two opposing plug and receptacle components partially offset in alignment from each other and illustrating how the misalignment is absorbed by the connector.

In the embodiment depicted in FIGS. 1–3, the configuration of the support flanges 202 assumes that of an isosceles triangle wherein the inclined surfaces 202C on both sides of the centerline generally have the same length and diverge equally away from the circuit board 20 so that the space between the flanges and the circuit board increases linearly on either side up to the maximum space "H" between the ends of the flanges 202 and a horizontal line "Z" parallel to the surface of the printed board 220.

The solder tail portions 225E, 225F of each female terminal 225A, 225B are soldered to corresponding contact pads or tabs of the printed circuit board 220, thereby fixing the receptacle member 201 to the printed circuit board 220 in a manner so that flange 202 may be spaced apart from or floats somewhat above the surface of the printed circuit board 220, leaving a small gap between its ridge 203 and the surface of the printed circuit board 220. Alternatively, the solder tail portions 225E, 225F may be mounted in a manner such that the flange ridges 203 contact the circuit board 220.

Similarly, a plug member 204 is fixed to an opposing printed circuit board 236 and is provided with a pair of flanges 205 at the ends of its elongated housing which extend above the surface of the printed circuit board 236 and extend transversely outwardly from the plug housing 231 and beneath the bottom 231A thereof.

As seen in FIG. 1, the flange 205 includes a central ridge 206 which extends along the longitudinal centerline X—X of the housing 231. The plug member flange 205 also includes a pair of individual surfaces 205, 205C which incline downwardly as shown, leaving gradually increasing spaces between the surfaces 205A, 205C and a horizontal line Z—Z parallel to the surface of the printed circuit board 236. The surfaces 205C diverge in a linear manner downwardly and outwardly to a height "H" as shown. The plug member 204 is fixed to the printed circuit board 236 by soldering the terminal solder tail portions 235C, 235D of the male terminals 35A and 35B to the corresponding contact pads or traces of the printed circuit board 236.

FIG. 2 illustrates a plug member 204 fixed to the printed circuit board 236, and a receptacle member fixed to an opposing printed circuit board 220. In FIG. 2, only one surface mount electric connector is shown affixed to the two printed circuit boards 220 and 236, but a plurality of such electric connectors may be affixed to these printed circuit boards in series and parallel fashions, such as is generally illustrated in FIG. 10.

In instances of proper engagement, i.e., where no misalignment or offset occurs between the longitudinal centerline X—X of housings 222,231 and a longitudinal reference mounting line Y—Y on the circuit board, the plug member 204 will mate with the receptacle member 201 as seen in FIG. 1. In such instances, the longitudinal sidewalls 222B, 222C of the receptacle housing 222 fit within the recess 233 of the plug housing 231, and the male terminals 235A and 235B enter the space between opposing female terminals 225A and 225B to establish an electric connection therebetween. In this offset-free mating position, the vertical centerline P—P extending between the opposing female terminals 225A and 225B of the receptacle housing 222 is aligned with the vertical centerline R—R extending between opposing male terminals 235A and 235B of the plug housing 231. When the receptacle housing 222 is fully inserted into the plug housing recess 233, a small gap 250 appears between the outer surface of each receptacle sidewall 222A, 222B and the inner surface of each longitudinal wall 231A, 222B of the plug housing 231.

The longitudinal walls 222 of the receptacle housing then properly accommodates the longitudinal walls 231B, 231C of the plug housing 231 and the small gaps 250 which occur between them are wide enough to permit smooth insertion of the plug connector 204 into the receptacle connector 201. These gaps need not be as wide as in the conventional electric connector of FIG. 11, so that the overall width of connectors of the present invention may be reduced.

In instances where misalignment occurs, such as an offset of the type indicated by S in FIG. 10 between the longitudinal centerline X—X of either of the receptacle or plug housings 222, 231 and a longitudinal mounting reference line Y—Y of the circuit board, a corresponding offset will occur between the longitudinal centerlines X—X of the receptacle and plug housings 222, 231. The plug member 204 then mates with the receptacle member 201 in the manner shown in FIG. 3. The opposite longitudinal walls of the plug housing 231 are chamfered at their inside ends 252 so the receptacle housing 222 may be easily guided into the recess 233 of the plug housing 231.

Importantly, when inserting the plug member 204 into the receptacle member 201, the receptacle and plug housings 222 and 231 are able to both rotate slightly counter-clockwise (as shown in FIG. 3) because of the structure of the flanges 202, 205 to absorb the offset "A" therebetween. The inclined surfaces 202C, 205A, 205C of the flanges 202, 205 of the respective receptacle and plug housings 222, 231 permit the housings to assume the tilted compensating positions as shown in FIG. 3. The male and female terminals 235A, 235B, 225A, 225B are made of thin, resilient metal and are resilient enough so that they may bend in order to follow the tilting of the plug and receptacle housings 222, 231 without causing any adverse effect on the connections between the circuit boards 220, 236 and their solder tail portions 225E, 225F, 235C and 35D. The terminal resiliency maintains the alignment between the inter-female terminal centerline P—P and the inter-male terminal centerline R—R with respect to the offset mating position, thus assuring reliable, good electric connections as required.

In instances wherein the offset occurs to the right of the centerline of the connector members as viewed in FIG. 3, the receptacle and plug housings 222, 231, will tilt clockwise to absorb the offset, and still assure the alignment between the inter-female terminal centerline P—P and the inter-male terminal center line R—R. In instances where the plug and receptacle housing are mounted to the circuit boards so that the flange central ridge portions 203,206 contact the surfaces of the circuit boards 220, 236, the ridge portions may act as fulcrums for the flanges.

FIGS. 4–9 illustrate alternate embodiments of support flanges with opposing inclined sides which extend away from an associated printed circuit board. In these six alternate embodiments, different flanges are illustrated as connected to receptacle housings. It will be understood that these figures are merely exemplary and are not intended as a limitation that such flanges will be associated with only the receptacle housing of connectors of the present invention. They can equally effectively be applied to plug housings.

Figure 4:
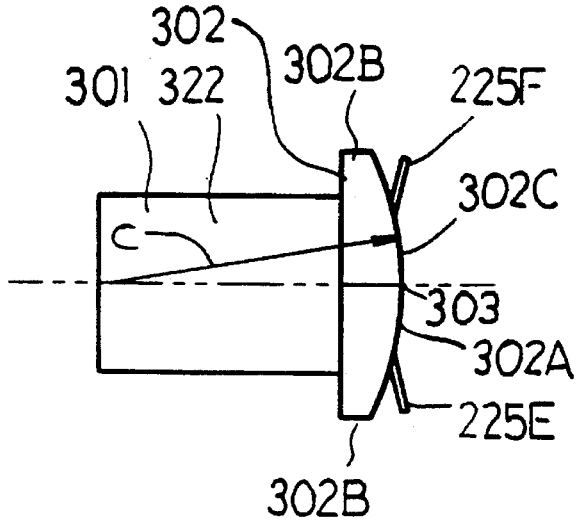
FIG. 4 is an end view of a second embodiment of a connector of the present invention, illustrating a second style of support flange.

FIG. 4 illustrates a flange 302 of a receptacle connector 301 which has a circular or arcuate contour. The flange 302 includes two curvilinear segments 302A, 302C having a common radius indicated by the arrow "C" which are separated by a ridge or apex 303. The curvilinear segments 302A, 302C end at upright end portions 302B.

Figure 5:
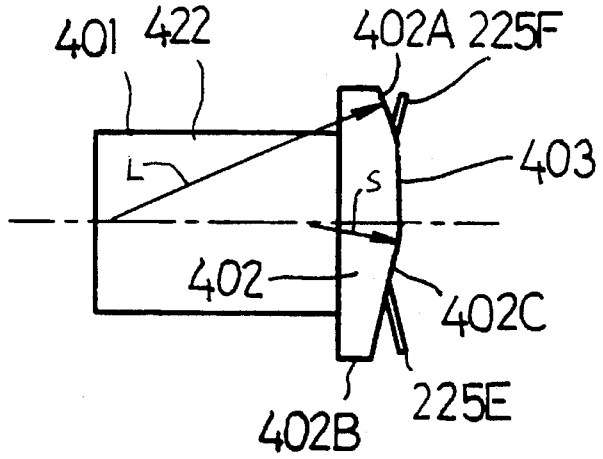
FIG. 5 is an end view of a third embodiment of a connector of the present invention, illustrating a third style of support flange.

FIG. 5 illustrates a third embodiment of a connector 401, having a receptacle housing 422 with support flanges 402 applied to opposite ends. The flange 402 has three definitive segments 402A, 402C and 403. One segment 402A has a short arc length of a large radius as indicated by the long arrow "L". Another segment 402C is linear "S". These two segments are separated by a relatively wide ridge 403 which has a curvilinear portion of a radius "S". The terminal solder tail portions 225E, 225F protrude through the housing bottom and extend outwardly relative to the arcuate segments 402A, 402C as illustrated.

Figure 6:
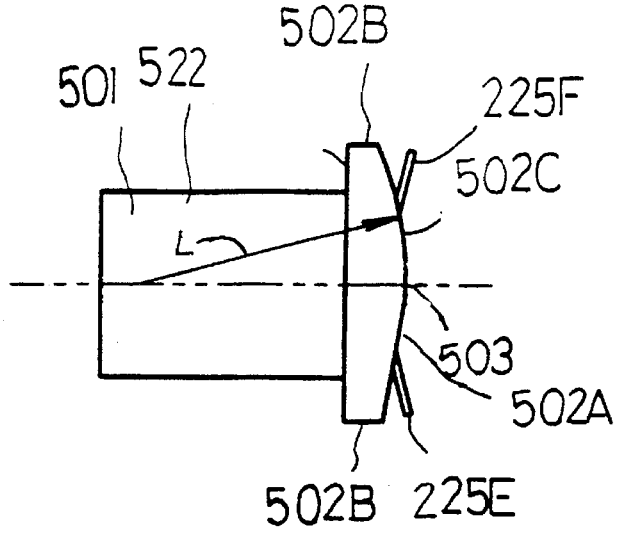
FIG. 6 is an end view of a fourth embodiment of a connector of the present invention, illustrating a fourth style of support flange.

FIG. 6 illustrates a fourth embodiment of a connector 501 of the present invention wherein the connector housing 522 includes support flanges 502 at its ends. The support flange 502 has a first diverging segment 502A which is linear and which diverges outwardly and upwardly from a linear central ridge segment 503 and a second diverging segment 502C which is curvilinear and which has a long radius "L" centered in the housing 522 as shown.

Figure 7:
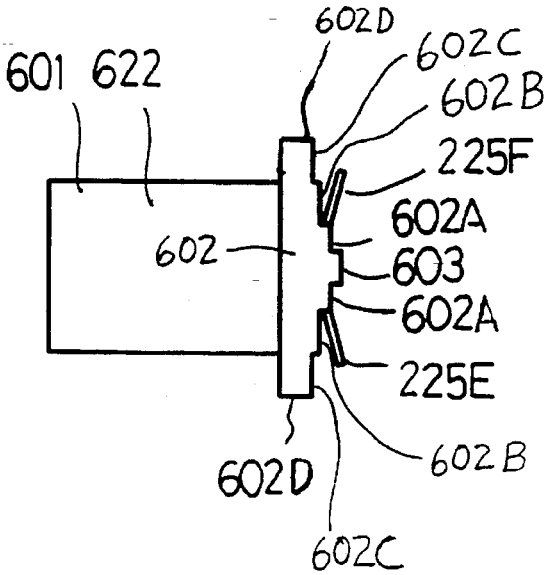
FIG. 7 is an end view of a fifth embodiment of a connector of the present invention, illustrating a fifth style of support flange.

FIG. 7 illustrates a fifth embodiment of a connector 601 wherein the connector housing 622 has a support flange 602 which is stepped in its inclined configuration. The flange 602 has a flat, central ridge segment 603 and a series of steps 602A, 602B, 602C which diverge upwardly and to the ends 602D of the flanges.

Figure 8:
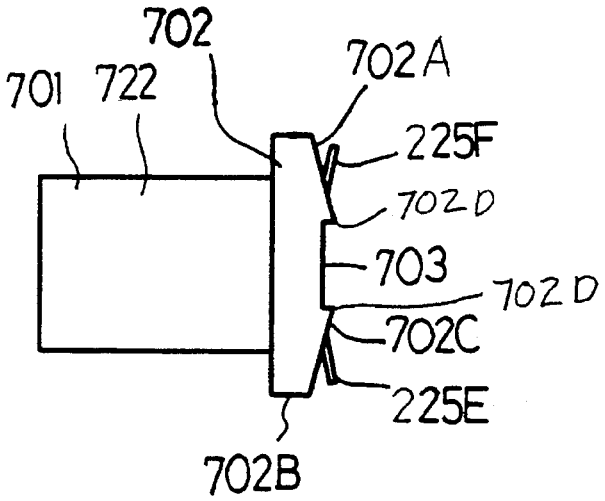
FIG. 8 is an end view of a sixth embodiment of a connector of the present invention, illustrating a sixth style of support flange.

FIG. 8 illustrates a sixth embodiment of a connector 701 wherein the connector housing 722 includes flanges 702 which have two opposing linear inclined surfaces 702A, 702C separated by a central recess, or notch 703. Such recess 703 creates a pair of ridges 702D in the lower surface of the flanges 702.

Figure 9:
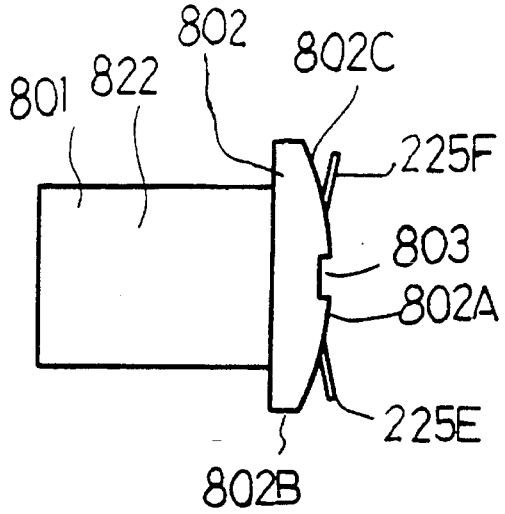
FIG. 9 is an end view of a seventh embodiment of a connector of the present invention, illustrating a seventh style of support flange.

Lastly, FIG. 9 illustrates a seventh embodiment of a connector 801 wherein the support flanges 802 attached to the connector housing 822 have two opposing curvilinear diverging surfaces 802A, 802C which are separated by a recess 803. This recess also creates a pair of ridges 802D in the lower surface of the flanges 802.

As may be understood from the above, a surface mount board-to-board connector constructed in accordance with the present invention uses plug and receptacle housings with inclined flanges connected to the ends thereof, thereby permitting these housings to rotate, or tilt, a limited amount so they may assume a compensating position which absorbs any offset appearing between the longitudinal centerline of either housing and a longitudinal reference mounting line of an associated printed circuit board.

Although the connectors as depicted in the figures includes solder tails for mounting to the surface of a circuit board, the present invention could be utilized with solder tails that extend into or through a circuit board in a "through hole" manner as is known in the art.

While the particular embodiments of the invention have been described above, it will be apparent to those skilled in the art that changes and modifications may be made therein without departing from the invention in its broader aspects, and, therefore, the aim of the appended claims is to cover all such changes and modifications as fall within the true spirit and scope of the invention.

We claim:

1. In an electrical connector for mounting on the surface of a circuit board, including:

an elongate dielectric housing having a longitudinal centerline, a pair of sidewalls extending generally parallel to said centerline, and a pair of rows of terminal receiving cavities, said rows being positioned on opposite sides of the longitudinal centerline of said housing and extending in a direction generally parallel to said longitudinal centerline, and a support flange positioned at each of opposite ends of said housing, said support flanges having a lower surface adapted to be mounted generally adjacent said circuit board;

a plurality of terminals secured within respective ones of said cavities, each terminal including a contact portion for contacting a mating electrical component, a securing section for securing said terminal within said housing and a tail portion adapted for soldering said terminal to a selected conductor of said circuit board, said tail portions of said plurality of terminals having ends that generally define a common plane;

characterized in that:

said lower surface of said support flanges including a central region and a pair of outer regions, said central region being generally located centrally of the support flange and said outer regions being located on opposite sides of said central region, said outer regions each diverging generally away from said common plane as they extend away from said first region, said central region including a portion located closer to said common plane than said outer regions, whereby upon mounting said electrical connector upon a circuit board, said electrical connector may rotate slightly until one of said outer regions of each support flange contacts said circuit board.

2. The electrical connector as defined in claim 1 wherein said outer regions of said support flanges are linear.

3. The electrical connector as defined in claim 2 wherein said central region includes a central ridge portion dividing said outer regions.

4. The electrical connector as defined in claim 2 wherein said central region is curvilinear.

5. The electrical connector as defined in claim 2 wherein said central region includes a recess and a pair of ridge portions.

6. The electrical connector as defined in claim 1 wherein said central region is curvilinear.

7. The electrical connector as defined in claim 1 wherein said outer regions of said support flanges are curvilinear.

8. The electrical connector as defined in claim 7 wherein said central region includes a central ridge portion dividing said outer regions.

9. The electrical connector as defined in claim 7 wherein said central region is curvilinear.

10. The electrical connector as defined in claim 9 wherein said central region and said outer regions are curved about a common axis.

11. The electrical connector as defined in claim 7 wherein said central region includes a recess and a pair of ridge portions.

12. The electrical connector as defined in claim 1 wherein one of said outer regions of said support flanges is linear and the other is curvilinear.

13. The electrical connector as defined in claim 1 wherein said outer regions of said support flanges are stepped.

14. The electrical connector as defined in claim 1 wherein said tail portions of said terminals are adapted for mounting to the surface of the circuit board.

15. The electrical connector as defined in claim 1 wherein said tail portions of said terminals are adapted for extending into the circuit board in a through hole manner.

16. The electrical connector as defined in claim 1 wherein a portion of each said support flange extends laterally beyond said sidewalls.

17. In an electrical connector assembly for interconnecting a pair of generally parallel circuit boards, said assembly including:

a plug connector for mounting on the surface of one of the circuit boards and for mating with a receptacle connector, including an elongate dielectric plug housing having a longitudinal centerline, a pair of sidewalls extending generally parallel to said centerline, and a pair of rows of terminal receiving cavities, said rows being positioned on opposite sides of the longitudinal centerline of said housing and extending in a direction generally parallel to said longitudinal centerline, and a support flange positioned at each of opposite ends of said housing, said support flanges having a lower surface adapted to be mounted generally adjacent said circuit board;

a plurality of plug terminals secured within respective ones of said cavities, each terminal including a contact portion for contacting a mating electrical component, a securing section for securing said terminal within said housing and a tail portion adapted for soldering said terminal to a selected conductor of said circuit board;

a receptacle connector for mounting on the surface of the other of the circuit boards and for mating with the plug connector, including an elongate dielectric receptacle housing having a longitudinal centerline, a pair of sidewalls extending generally parallel to said centerline, and a pair of rows of terminal receiving cavities, said rows being positioned on opposite sides of the longitudinal centerline of said housing and extending in a direction generally parallel to said longitudinal centerline, and a support flange positioned at each of opposite ends of said housing, said support flanges having a lower surface adapted to be mounted generally adjacent said circuit board;

a plurality of receptacle terminals secured within respective ones of said cavities, each terminal including a contact portion for contacting a mating electrical component, a securing section for securing said terminal within said housing and a tail portion adapted for soldering said terminal to a selected conductor of said circuit board;

characterized in that:

said lower surface of said support flanges includes a pair of diverging surfaces disposed on opposite sides of respective centerlines of the plug and receptacle, the diverging surfaces extending generally away from said circuit boards upon which they are adapted to be mounted as they extend away from the respective centerlines to thereby define spaces between said diverging surfaces and said circuit boards, the spaces having depths that increase as said diverging surfaces extend away from said centerlines, whereby said diverging surfaces permit said plug and receptacle connectors to generally rotate about their centerlines in order to compensate for any misalignment between said plug and receptacle connectors upon mating thereof.

18. The connector assembly as defined in claim 17 wherein said flange diverging surfaces are linear.

19. The connector assembly as defined in claim 17 wherein said flange diverging surfaces are curvilinear.

20. The connector assembly as defined in claim 17 wherein said flange diverging surfaces include at least one linear surface and one curvilinear surface.

21. The connector assembly as defined in claim 17 wherein said flange diverging surfaces are stepped.

22. The connector assembly as defined in claim 17, wherein each of said flanges includes a central ridge portion dividing said diverging surfaces of each of said flanges.

* * * * *